US006968667B2

(12) United States Patent
Spatafora

(10) Patent No.: US 6,968,667 B2
(45) Date of Patent: Nov. 29, 2005

(54) CIGARETTE PACKING METHOD AND MACHINE

(75) Inventor: Mario Spatafora, Bologna (IT)

(73) Assignee: G.D Societa' per Azioni, Bologna (IT)

( * ) Notice: Subject to any disclaimer, the term of this patent is extended or adjusted under 35 U.S.C. 154(b) by 91 days.

(21) Appl. No.: 10/794,765

(22) Filed: Mar. 5, 2004

(65) Prior Publication Data

US 2004/0231297 A1 Nov. 25, 2004

(30) Foreign Application Priority Data

Mar. 6, 2003 (IT) ..... BO2003A0123

(51) Int. Cl.[7] ..... B65B 11/28
(52) U.S. Cl. ..... 53/234; 53/579
(58) Field of Search ..... 53/466, 225, 234, 53/575, 579

(56) References Cited

U.S. PATENT DOCUMENTS 3,956,865 A * 5/1976 Schmermund ..... 53/234
6,286,291 B1 * 9/2001 Tale' et al. ..... 53/579
6,625,957 B2 * 9/2003 Spatafora ..... 53/466
6,789,370 B2 * 9/2004 Spatafora ..... 53/234

FOREIGN PATENT DOCUMENTS

| | | |
|---|---|---|
| EP | 0 340 526 A | 11/1989 |
| EP | 0 741 081 A | 11/1996 |
| EP | 1 145 958 A | 10/2001 |
| EP | 1 321 364 A | 6/2003 |

* cited by examiner

*Primary Examiner*—John Sipos
(74) *Attorney, Agent, or Firm*—Ladas & Parry LLP

(57) ABSTRACT

A cigarette packing method and machine, whereby an output wheel feeds along a folding path a number of gripping heads, each of which receives and retains, by the ends, a relative packet having minor lateral walls, each defined by an inner longitudinal tab and an outer longitudinal tab superimposed one on top of the other; each packet is fed onto the folding path with its outer longitudinal tabs open, detached from the respective inner longitudinal tabs, and supported by respective folding wings carried by the gripping head; and the folding path extends through a folding station where the folding wings of each gripping head are moved to fold the respective outer longitudinal tabs into a closed position contacting the relative inner longitudinal tabs, and, at the same time, an outward-facing major lateral wall of each packet is kept flat by contact with an external contrast device.

16 Claims, 4 Drawing Sheets

CIGARETTE PACKING METHOD AND MACHINE

The present invention relates to a cigarette packing method and machine.

BACKGROUND OF THE INVENTION

In the tobacco industry, cigarette packing machines are known comprising an output wheel which rotates about a respective axis to feed a number of gripping heads along a folding path. Each gripping head is engaged by and retains a respective packet of cigarettes comprising two minor longitudinal lateral walls, each of which is defined by an outer longitudinal tab and an inner longitudinal tab superimposed and connected integrally to each other.

In known machines of the above type, each gripping head receives the relative packet with the relative outer longitudinal tabs in an open position, and comprises two folding wings, each of which is movable, at a folding station extending along a portion of the folding path, from an initial open position supporting the relative outer longitudinal tab in the open position, and a final closed position to fold the relative outer longitudinal tab into a closed position contacting the relative inner longitudinal tab.

In known machines of the above type, the movement of the folding wings into the final closed position has been found to compress the packets transversely, thus resulting, particularly when using thin blanks, in at least one of the major lateral walls of the packets bulging outwards.

SUMMARY OF THE INVENTION

It is an object of the present invention to provide a cigarette packing method and machine designed to eliminate the aforementioned drawback.

According to the present invention, there is provided a cigarette packing method as claimed in claim 1 and, preferably, in any one of the following claims depending directly or indirectly on claim 1.

According to the present invention, there is also provided a cigarette packing machine as claimed in claim 8 and, preferably, in any one of the following claims depending directly or indirectly on claim 8.

BRIEF DESCRIPTION OF THE DRAWINGS

A number of non-limiting embodiments of the present invention will be described by way of example with reference to the accompanying drawings, in which.

DETAILED DESCRIPTION OF THE INVENTION

Figure 1:
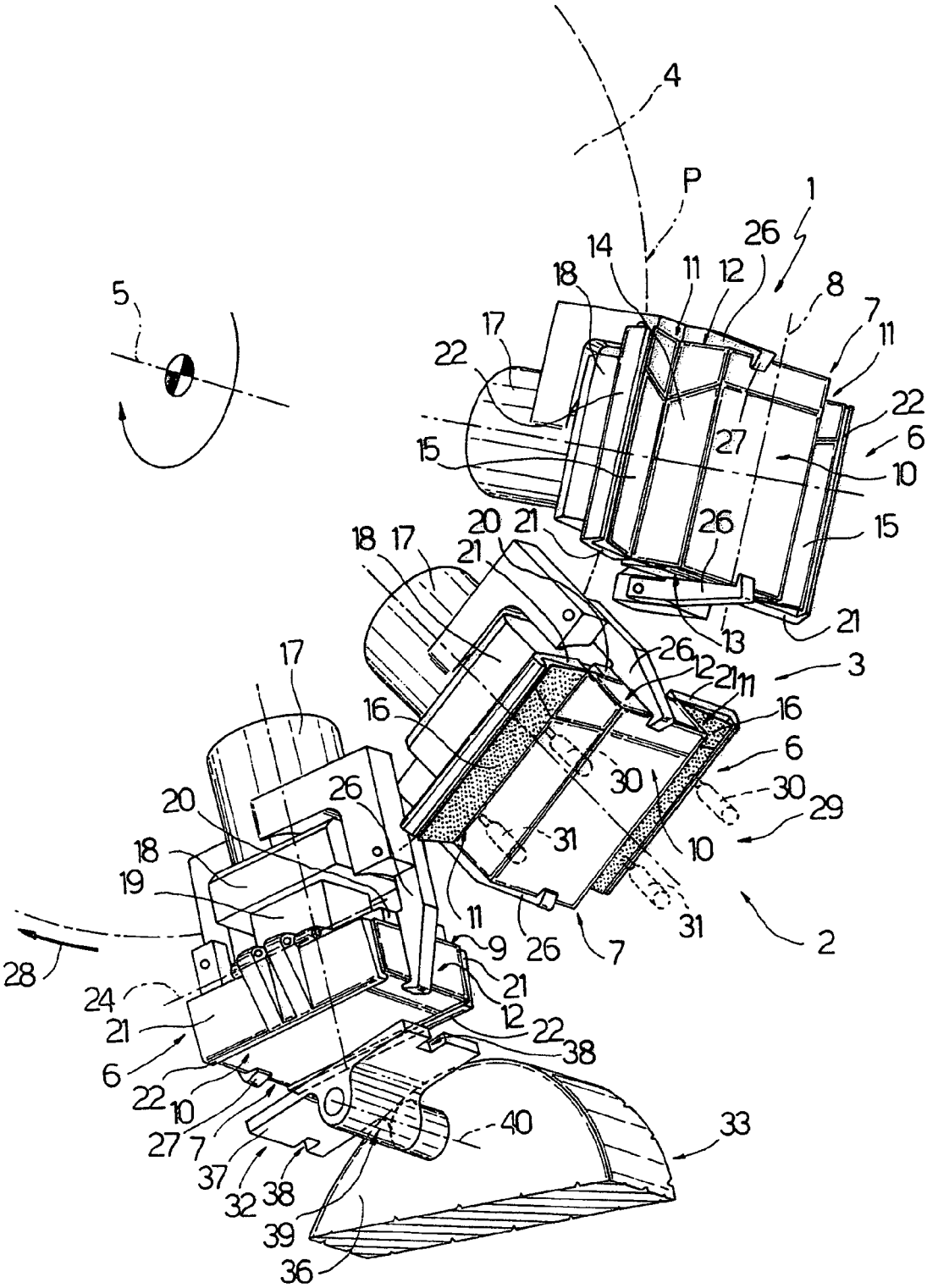
FIG. 1 shows a view in perspective, with parts removed for clarity, of an output portion of a first preferred embodiment of the packing machine according to the present invention in a first operating configuration.

Number 1 in FIG. 1 indicates as a whole a cigarette packing machine, an output portion 2 of which comprises an output wheel 3, in turn comprising a powered central disk 4 which rotates continuously (clockwise in FIG. 1) about a respective central axis 5. Output wheel 3 also comprises a number of gripping heads 6 equally spaced along the periphery of central disk 4, and for receiving respective packets 7 of cigarettes, still partly open, at an input station (not shown), for feeding respective packets 7 along a circular folding path P to an output station (not shown), and for completing closure of respective packets 7 as they are fed along folding path P.

Each packet 7 is a rigid, hinged-lid packet substantially in the form of a rectangular parallelepiped, and having a longitudinal axis 8; a front major lateral wall 9 and a rear major lateral wall 10 parallel to each other and to longitudinal axis 8; two minor lateral walls 11 parallel to each other and to longitudinal axis 8 and perpendicular to major lateral walls 9 and 10; and two end walls 12 and 13. Each minor lateral wall 11 is defined by an inner longitudinal tab 14 connected to a lateral edge of the relative rear major lateral wall 10, and by an outer longitudinal tab 15 connected to a lateral edge of the relative front major lateral wall 9. Tabs 14 and 15 are superimposed and glued to each other with the interposition of a layer of glue 16, which may be defined by hot glue, cold glue, or, as in the example shown, by hot and cold glue.

As shown more clearly in FIG. 1, each gripping head 6 comprises a tubular shaft 17 connecting relative gripping head 6 to central disk 4, and fitted integrally on its outer end with a substantially rectangular end plate 18, from which projects outwards a further tubular shaft 19 coaxial with relative tubular shaft 17 and closed at its outer end by a substantially rectangular plate 20 parallel to end plate 18. Tubular shafts 17 and 19 house a known mechanism (not shown) for controlling the angular position of two wings 21, each of which has an end tooth 22 (dispensed with in a variation not shown) facing the other wing 21, and is hinged to a lateral edge of plate 20 to rotate—about a respective axis 24 and as relative gripping head 6 travels through a folding station 23 extending along a portion of folding path P—between an open position (on the right in FIG. 1) in which wing 21 is substantially coplanar with plate 20, and a normal closed position (on the left in FIG. 1) in which wing 21 is perpendicular to plate 20.

In the closed position, wings 21 and respective end teeth 22 define, together with relative plate 20, a seat 25 for receiving and retaining a relative packet 7 positioned with longitudinal axis 8 parallel to axes 24, with front major lateral wall 9 contacting plate 20, and with rear major lateral wall 10 facing outwards with respect to central disk 4.

Two diametrically opposite jaws 26 are hinged to the outside of tubular shaft 17, each has a transverse end tooth 27, and each is rotated—by a known actuating device (not shown) carried by central disk 4, and in a plane parallel to axes 24 and perpendicular to the plane of plate 20—between an open position and a closed position closing a respective end of relative seat 25.

In actual use, each gripping head 6 travels along a portion of folding path P upstream from folding station 23 with wings 21 in the open position, and with jaws 26 in the closed position to retain inside relative seat 25 a respective packet 7 positioned with longitudinal axis 8 parallel to a travelling direction 28 of relative gripping head 6 along folding path P, with relative front major lateral wall 9 contacting plate 20, and with relative outer longitudinal tabs 15 open and contacting respective wings 21.

Before reaching folding station 23, gripping head 6 and relative packet 7 are fed through a gumming station 29, where two hot-glue gumming devices 30, located in fixed positions on opposite sides of folding path P, and two cold-glue gumming device 31, also located in fixed positions on opposite sides of folding path P, deposit spots of hot and cold glue respectively to form a layer of glue 16 on the inner surface of each of outer longitudinal tabs 15, still in the open position contacting relative wings 21, which are moved into the closed position as they subsequently travel through folding station 23.

In variations not shown, only hot-glue gumming devices 30 or only cold-glue gumming devices 31 are used at gumming station 29.

Closure of wings 21 provides, on the one hand, for completing closure of packet 7, and, on the other, if teeth 22 are provided, for further connecting packet 7 to gripping head 6, by teeth 22, as wings 21 close, engaging rear major lateral wall 10 of packet 7 to further secure packet 7 on plate 20.

As wings 21 are closed, i.e. as relative gripping head 6 travels through folding station 23, gripping head 6 is accompanied along folding path P by a contrast member 32 fitted to a contrast device 33 and for preventing major lateral walls 9 and 10, and in particular rear major lateral wall 10, from bulging outwards as a result of the lateral compression applied by wings 21 as they are closed.

Figure 2:
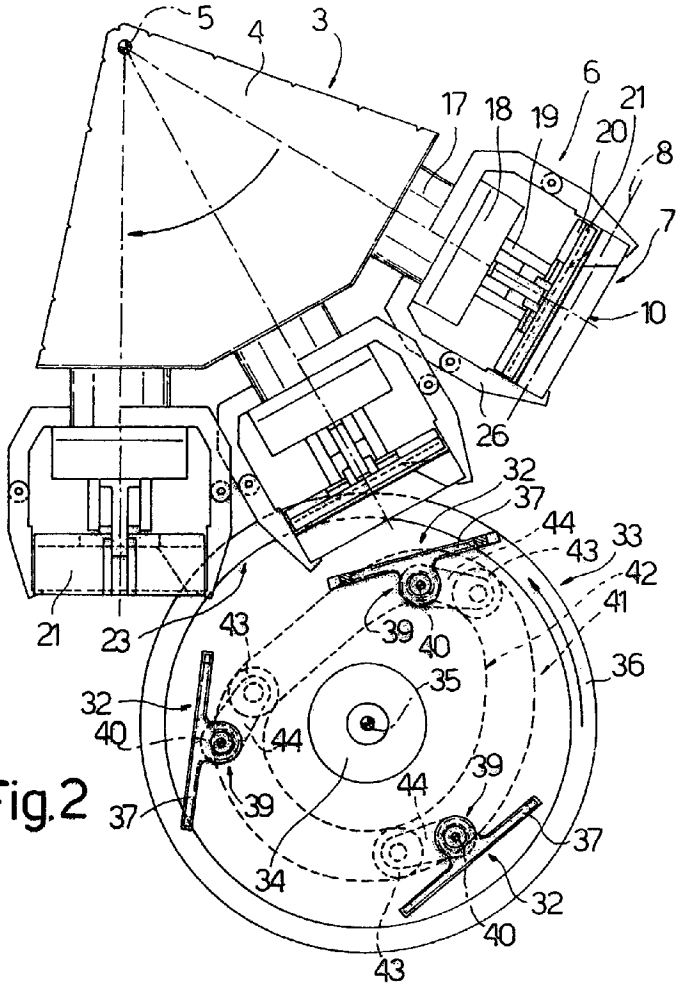
FIGS. 2 and 3 show partial side views of the FIG. 1 detail in a further two operating configurations.
Figure 3:
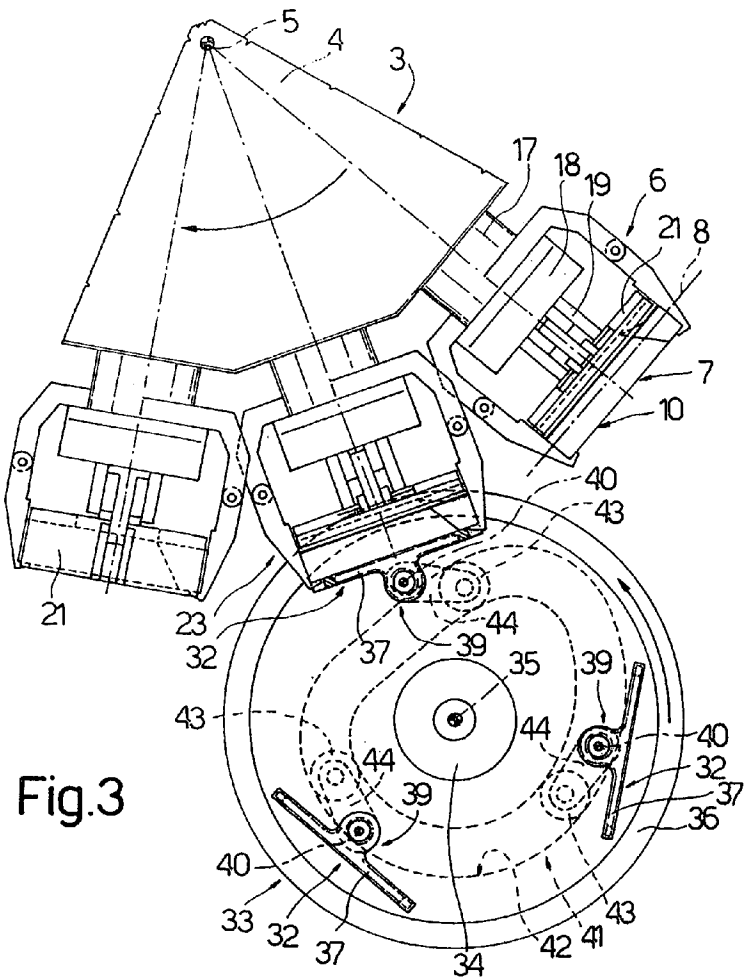

As shown in FIGS. 2 and 3, contrast device 33 comprises a powered shaft 34 mounted to rotate (anticlockwise in FIGS. 2 and 3) about a respective axis 35 extending parallel to axis 5 and outside folding path P. Shaft 34 is fitted with a disk 36, in turn fitted with a number of contrast members 32 (three in the example shown, but which may differ in number) equally spaced about axis 35, and each comprising a substantially rectangular plate 37, which is substantially the same width as rear major lateral wall 10, if no teeth 22 are provided, or, conversely, is approximately as wide as but no wider than the distance between the facing ends of end teeth 22 of wings 21 of gripping head 6 when wings 21 are in the closed position. Each plate 37 is also substantially the same length as major lateral walls 9 and 10, and has, along each minor lateral edge, a recess 38 for receiving, in use, the end tooth 27 of a respective jaw 26 of respective gripping head 6.

Each contrast member 32 also comprises a hinge 39 connecting relative plate 37 to disk 36 to enable plate 37 to rotate with respect to disk 36 about a respective axis 40 parallel to axis 35. The angular position of each plate 37 about relative axis 40 and with respect to disk 36 is controlled by a cam device 41 comprising a fixed annular track 42 extending about axis 35 and travelled, in use, by cam followers 43, each of which is fitted to a respective lever 44 integral with a respective plate 37.

In actual use, shaft 34 is operated synchronously with output wheel 3, so that each gripping head 6 is accompanied, as it travels through folding station 23, by a respective contrast member 32, the plate 37 of which is positioned contacting rear major lateral wall 10 of relative packet 7 to press packet 7 against relative plate 20, and rotates about axis 35 and also about relative axis 40 under the control of cam device 41, so as to remain parallel to plate 20 for as long as it takes for wings 21 to fold relative outer longitudinal tabs 15 squarely, and so prevent relative rear major lateral wall 10 from bulging outwards.

Figure 4:
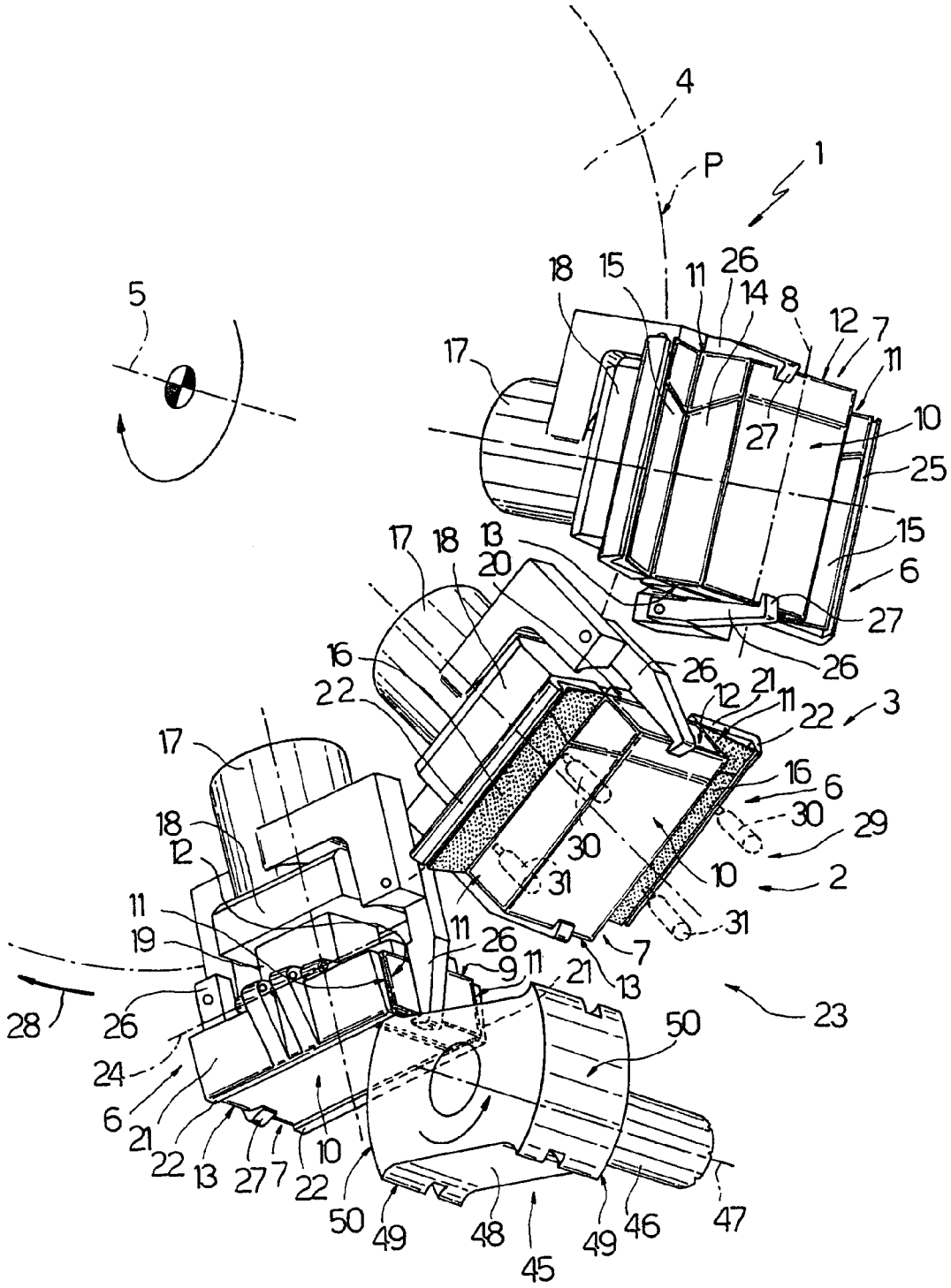
FIG. 4 shows the same view as in FIG. 1, of an output portion of a second preferred embodiment of the packing machine according to the present invention in a first operating configuration.
Figure 5:
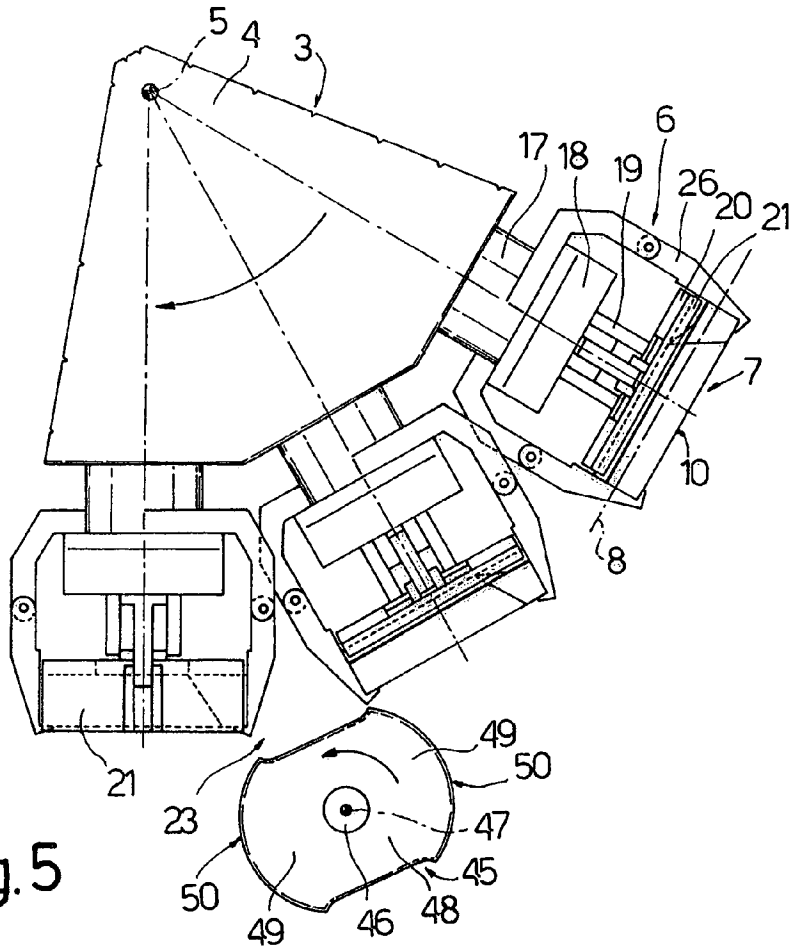
FIGS. 5 and 6 show side views of the FIG. 4 detail in a further two operating configurations.
Figure 6:
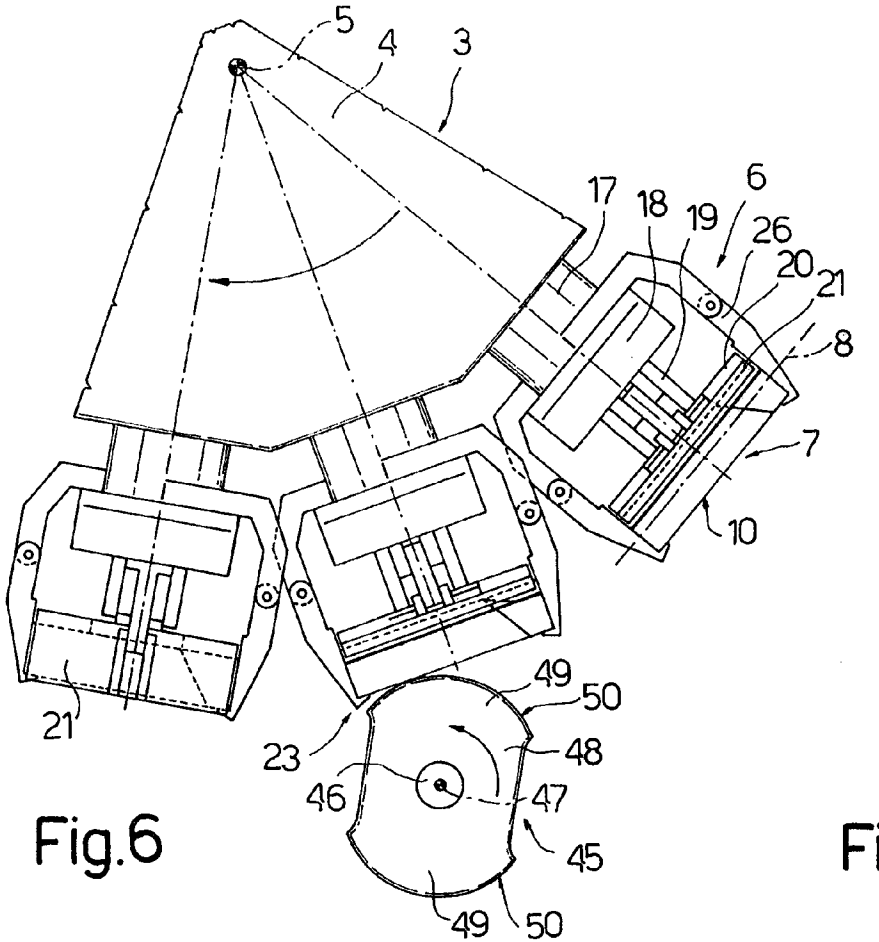

In the embodiment shown in FIGS. 4 to 6, the configuration assumed by rear major lateral wall 10 of each packet 7 as relative outer longitudinal tabs 15 are folded is controlled by a contrast device 45 comprising a powered shaft 46, which is mounted at folding station 23 to rotate about a respective axis 47 parallel to axis 5 and outside folding path P. Shaft 46 is fitted with a substantially rectangular plate 48 perpendicular to axis 47 and having, at each longitudinal end (or, in a variation not shown, at only one longitudinal end), an enlarged head 49 defining a respective contrast member. For which purpose, each head 49 is bounded externally by an outwardly convex rolling surface 50 which, as shaft 46 rotates and a gripping head 6 and a relative packet 7 travel through folding station 23, rolls on rear major lateral wall 10 of packet 7 to prevent rear major lateral wall 10 from deforming outwards.

What is claimed is:

1. A method of packing cigarettes in packets (7) having two major lateral walls (9, 10); and two minor lateral walls (11), each defined by an inner longitudinal tab (14) and an outer longitudinal tab (15) superimposed and integral with each other; the method comprising the steps of feeding said packets (7) successively along a folding path (P) extending through a folding station (23), each packet (7) being fed along the folding path (P) by a relative gripping head (6) for retaining the relative packet (7) by the ends and with the outer longitudinal tabs (15) of the packet in an open position, detached from the respective inner longitudinal tabs (14), and supported, in said open position, by respective folding wings (21) carried by the gripping head (6); and moving said folding wings (21) of each gripping head (6), at said folding station (23), to fold each outer longitudinal tab (15) into a closed position contacting the relative inner longitudinal tab (14); and being characterized by comprising the further step of bringing and keeping an external contrast member (32; 49) into/in contact with a substantially free said major lateral wall (10), facing outwards with respect to the relative said gripping head (6), of each packet (7) during at least part of the time the packet (7) travels through said folding station (23).

2. A method as claimed in claim 1, wherein said folding path (P) extends through a gumming station (29) upstream from said folding station (23); glue being fed between each outer longitudinal tab (15) and the relative inner longitudinal tab (14) at said gumming station (29).

3. A method as claimed in claim 1, wherein said contact between the contrast member (32) and the relative said major lateral wall (10) is a static contact with zero relative speed between the contrast member (32) and the relative packet (7).

4. A method as claimed in claim 3, wherein said contrast member (32) is rotated about a first axis (35), outside said folding path (P), to travel through said folding station (23) synchronously with a relative said gripping head (6), and is oscillated about a second axis (40), parallel to said first axis (35), to remain constantly parallel to the relative said major lateral wall (10) inside said folding station (23).

5. A method as claimed in claim 1, wherein said contrast member (32) comprises a flat plate (37).

6. A method as claimed in claim 1, wherein said contact between the contrast member (49) and the relative said major lateral wall (10) is a dynamic contact with relative movement between the contrast member (49) and the relative packet (7).

7. A method as claimed in claim 6, wherein said relative movement is a rolling movement of said contrast member (49) on the relative said major lateral wall (10).

8. A machine for packing cigarettes in packets (7) having two major lateral walls (9, 10); and two minor lateral walls (11), each defined by an inner longitudinal tab (14) and an outer longitudinal tab (15) superimposed and integral with each other; the machine comprising conveying means (3) for feeding said packets (7) successively along a folding path (P) extending through a folding station (23); said conveying means (3) comprising a succession of gripping heads (6), each of which comprises gripping means (26) for retaining the relative packet (7) by the ends and with the outer longitudinal tabs (15) of the packet in an open position detached from the respective inner longitudinal tabs (14), and two folding wings (21), each of which is movable, at said folding station (23), from an initial open position supporting the relative outer longitudinal tab (15) in the open position, to a final closed position to fold the relative outer longitudinal tab (15) into a closed position contacting the relative inner longitudinal tab (14); and being characterized by comprising at least one external contrast member (32; 49), and actuating means for bringing and keeping said contrast member (32; 49) into/in contact with a substantially free said major lateral wall (10), facing outwards with respect to the relative said gripping head (6), of each packet (7) during at least part of the time the packet (7) travels through said folding station (23).

9. A machine as claimed in claim 8, and also comprising gumming means located at a gumming station (29) located along said folding path (P) and upstream from said folding station (23) to feed glue between each outer longitudinal tab (15) and the relative inner longitudinal tab (14).

10. A machine as claimed in claim 8, and comprising a contrast device (33) for activating said contrast member (32) so that said contact between the contrast member (32; 49) and the relative said major lateral wall (10) is a static contact with zero relative speed between the contrast member (32) and the relative packet (7).

11. A machine as claimed in claim 10, wherein said contrast device (33) comprises a powered shaft (34) mounted to rotate about a respective axis (35) crosswise to and extending outside the folding path (P); a support (36) integral with said shaft (34); a hinge (39) interposed between said contrast member (32) and said support (36) to enable the contrast member (32) to rotate with respect to said support (36) about a second axis (40) parallel to said first axis (35); and control means (41) for controlling an angular position of said contrast member (32) about said second axis (40) according to a given law.

12. A machine as claimed in claim 11, wherein said contrast member (32) comprises a flat plate (37) which is brought into contact with said major lateral wall (10) of a relative said packet (7).

13. A machine as claimed in claim 11, wherein said control means (41) comprise a cam device, in turn comprising a fixed annular track (42) extending about said first axis (35), and cam follower means (43) engaging said annular track (42) and connected to said contrast member (32).

14. A machine as claimed in claim 8, and comprising a contrast device (45) for activating said contrast member (49) so that said contact between the contrast member (49) and the relative said major lateral wall (10) is a dynamic contact with relative movement between the contrast member (49) and the relative packet (7).

15. A machine as claimed in claim 14, wherein said relative movement is a rolling movement of said contrast member (49) on the relative said major lateral wall (10).

16. A machine as claimed in claim 14, wherein said contrast device (45) comprises a powered shaft (46) mounted at the folding station (23) to rotate about a respective axis (47) extending crosswise to and outside said folding path (P); and a plate (48) fitted to said shaft (46) and having at least one enlarged peripheral head (49), which defines said contrast member (49) and is bounded externally by a rolling surface (50) which rolls on said major lateral wall (10) of a relative said packet (7) travelling through said folding station (23).

* * * * *